US010684074B1

(12) United States Patent
Zoucha

(10) Patent No.: US 10,684,074 B1
(45) Date of Patent: Jun. 16, 2020

(54) HEAT EXCHANGER AND DEHUMIDIFIER APPARATUS

(71) Applicant: James Zoucha, Orchard, NE (US)

(72) Inventor: James Zoucha, Orchard, NE (US)

( * ) Notice: Subject to any disclaimer, the term of this patent is extended or adjusted under 35 U.S.C. 154(b) by 93 days.

(21) Appl. No.: 15/986,309

(22) Filed: May 22, 2018

(51) Int. Cl.
*F26B 3/34* (2006.01)
*F26B 23/00* (2006.01)
*F26B 17/12* (2006.01)

(52) U.S. Cl.
CPC ..... *F26B 23/00* (2013.01); *F26B 17/122* (2013.01)

(58) Field of Classification Search
CPC ..... F26B 3/02; F26B 3/06; F26B 3/20; F26B 3/28; F26B 3/30; F26B 23/00; F26B 17/122
USPC ..... 34/266–269, 467, 476, 417, 201, 218, 34/227, 231
See application file for complete search history.

(56) References Cited

U.S. PATENT DOCUMENTS 8,291,609 B2 10/2012 Zoucha
8,434,239 B2 * 5/2013 Zoucha ..... F26B 17/14 34/218
2011/0167666 A1 * 7/2011 Zoucha ..... F26B 3/305 34/267

* cited by examiner

*Primary Examiner* — John P McCormack
(74) *Attorney, Agent, or Firm* — Dennis L. Thomte; Thomte Patent Law Office LLC

(57) ABSTRACT

A heat exchanger and dehumidifier apparatus for use in grain drying operations or other applications. The heat exchanger and dehumidifier apparatus includes a shroud having an air inlet end and an air discharge end. First, second, third and fourth heat exchangers and dehumidifier assemblies are positioned in the shroud which define an air passageway extending therethrough having an inlet end and a discharge end. A blower is positioned at the discharge end of the shroud for blowing heated and dehumidified air therefrom.

2 Claims, 5 Drawing Sheets

HEAT EXCHANGER AND DEHUMIDIFIER APPARATUS

BACKGROUND OF THE INVENTION

Field of the Invention

This invention relates to a heat exchanger and dehumidifier apparatus. More particularly, the invention relates to a heat exchanger and dehumidifier apparatus which includes a blower which blows heated and dehumidified air from the apparatus. More particularly, this invention is well served for use in grain drying operations. Even more particularly, this invention relates to a heat exchanger and dehumidifier apparatus which may be used in other applications.

Description of the Related Art

Many devices have been previously provided for drying grain contained within a storage bin. See for example, Applicant's U.S. Pat. Nos. 8,291,609 and 8,434,239 which represent improvements in the grain drying art.

U.S. Pat. No. 8,291,609 illustrates and describes a heat exchanger 30. U.S. Pat. No. 8,434,239 illustrates and describes a heat exchanger 30. Although the inventions of the above-identified patents have been very successful, farm operations have begun to involve a considerable variety of storage bin sizes and their associated bin fans, along with a range of cubic-feet-per-minute ratings that not always maximize or are compatible with the capacity of Applicant's previous dehumidifiers and heat exchangers such as shown in Applicant's patents. It is for the above changes in grain drying operations that Applicant has provided a new and improved heat exchanger and dehumidifier apparatus that will not only improve grain drying systems but has provided a heat exchanger and dehumidifier that may be used in other applications or systems.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A heat exchanger and dehumidifier apparatus is disclosed which includes a shroud having an upper wall, a lower wall, a first side wall, a second side wall, an open inlet and an outlet end. The upper and lower walls of the shroud have a trapezoidal shape. The upper wall of the shroud includes an inlet end, an outlet end, a first side and a second side. The lower wall of the shroud includes an inlet end, an outlet end, a first side and a second side. The first side wall of the shroud includes an inlet end, an outlet end, an upper end and a lower end. The second side wall of the shroud includes an inlet end, an outlet end, an upper end and a lower end. The inlet ends of the upper and lower walls of the shroud have a greater width than the outlet ends of the upper and lower walls whereby the upper and lower walls of the shroud define a trapezoidal shape with the inlet end of the shroud having a greater width than the outlet end thereof.

An upper heat exchanger and dehumidifier assembly is positioned in the shroud below the upper wall of the shroud with the upper heat exchanger and dehumidifier assembly having a first end, a second end, a first side and a second side. The upper heat exchanger and dehumidifier assembly has a trapezoidal shape. A lower heat exchanger and dehumidifier assembly is positioned in the shroud above the lower wall of the shroud. The lower heat exchanger and dehumidifier assembly has a first end, a second end, a first side and a second side. The lower heat exchanger and dehumidifier assembly has a trapezoidal shape. A first side heat exchanger and dehumidifier assembly is positioned in the shroud inwardly of the first sidewall of the shroud. The first side heat exchanger and dehumidifier assembly has a first end, a second end, an upper end and a lower end. The first side heat exchanger and dehumidifier assembly has a trapezoidal shape. A second side heat exchanger and dehumidifier assembly is positioned in the shroud inwardly of the second wall of the shroud with the second side heat exchanger and dehumidifier assembly having a first end, a second end, an upper end and a lower end. The second side heat exchanger and dehumidifier assembly has a trapezoidal shape. Each of the heat exchanger and dehumidifier assemblies have a plurality of spaced-apart vanes provided thereon.

The upper heat exchanger and dehumidifier assembly, the lower heat exchanger and dehumidifier assembly, the first side heat exchanger and dehumidifier assembly and the second side heat exchanger and dehumidifier assembly define a heat exchanger and dehumidifier having an air passageway extending therethrough with an inlet end and an outlet end. An electric motor is mounted on the upper wall of the shroud at the outlet end thereof. An electric blower is positioned in the shroud at the outlet end of the upper wall of the shroud. The electric blower has an air inlet end and an air discharge end. The electric blower is coupled to the electric motor whereby the electric blower blows heated and dehumidified air outwardly from the outlet end of the air passageway.

It is therefore a principal object of the invention to provide an improved heat exchanger and dehumidifier apparatus.

A further object of the invention is to provide an improved heat exchanger and dehumidifier apparatus which is ideally suited for use in grain drying operations.

A further object of the invention is to provide a heat exchanger and dehumidifier apparatus which includes a blower at the discharge end thereof for blowing dehumidified and heated air from the heat exchanger and dehumidifier apparatus.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The invention of this application will be described as being used in a grain drying operation although the invention may be used in other applications as stated hereinabove. The instant invention represents an improvement of the heat exchangers shown and described in Applicant's patents set forth above.

Figure 1:
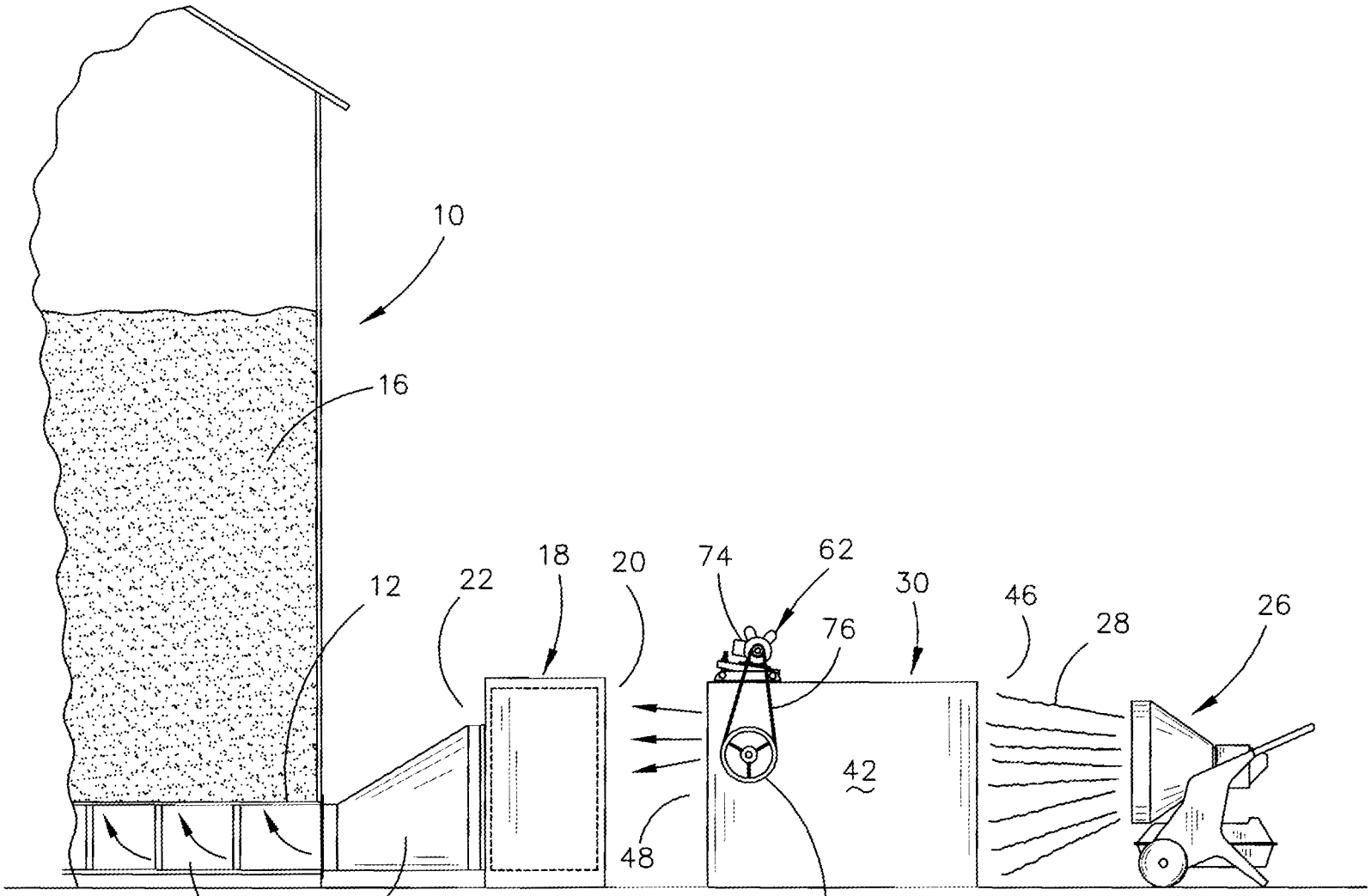
FIG. 1 is a side view illustrating the heat exchanger and dehumidifier apparatus of this invention being used in a grain drying operation.

In FIG. 1, the numeral 10 refers to a conventional storage bin which has a perforated floor 12 spaced above the lower end thereof with a plenum 14 being provided beneath the floor 12. Normally, the storage bin 10 will have a pair of air outlets positioned in the roof thereof and will have a conventional selectively closable center opening formed therein at the peak of the roof. The numeral 16 refers to grain contained within the storage bin.

A conventional air blower or fan 18 is provided which has an air inlet end 20 and an air discharge end 22 which is in communication with a transition housing or shroud 24 which extends to the plenum 14 so that when the blower 18 is activated, air will be blown into the plenum 14 and upwardly through the perforated floor 12 into the grain and then pass outwardly from the bin 10 by way of the outlets and central opening in the roof of the bin 10. The blower 18 may be either an axial flow blower or a centrifugal blower.

Figure 3:
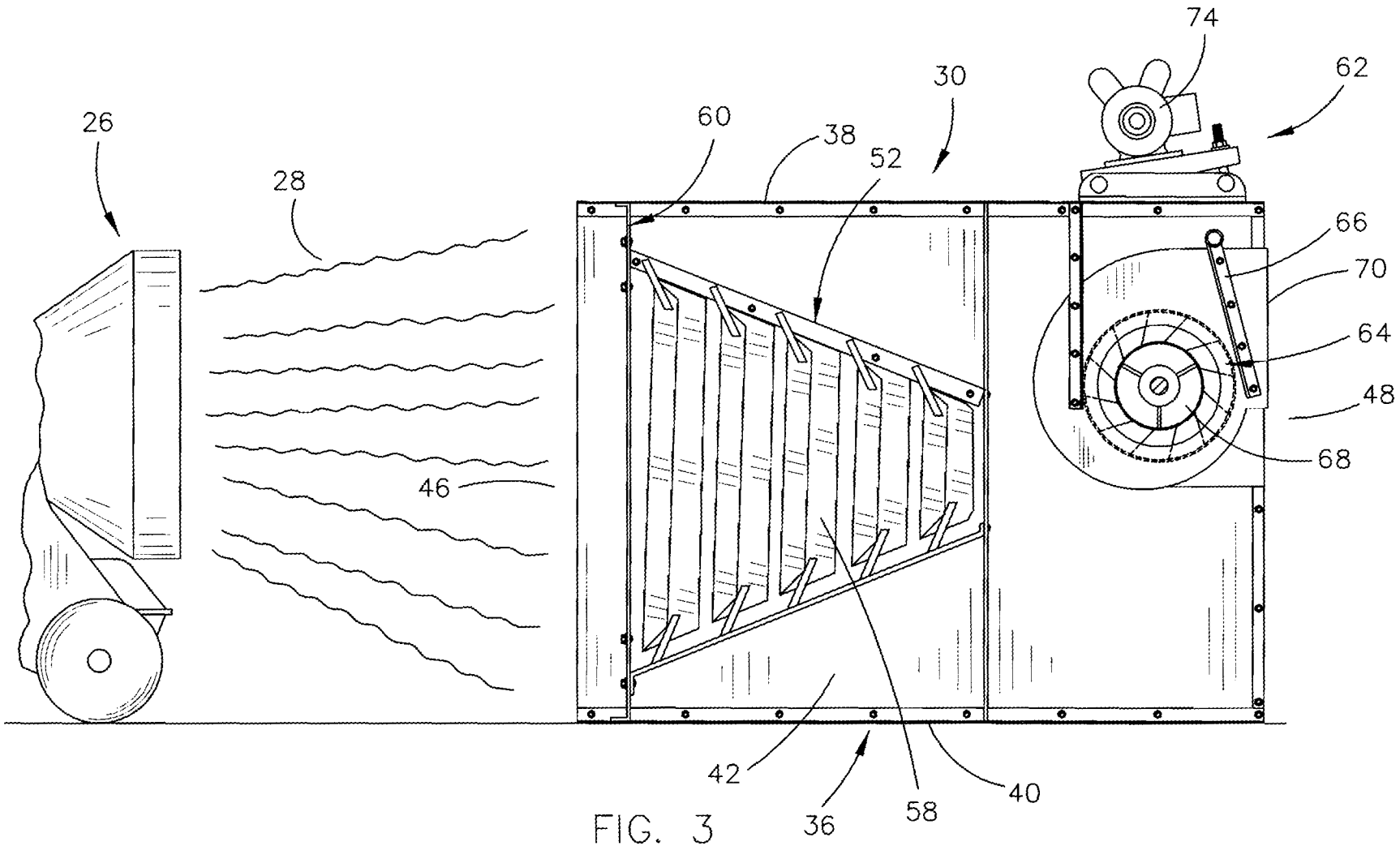
FIG. 3 is a sectional view of the heat exchanger and dehumidifier apparatus as used in the grain drying system of FIG. 1.
Figure 4:
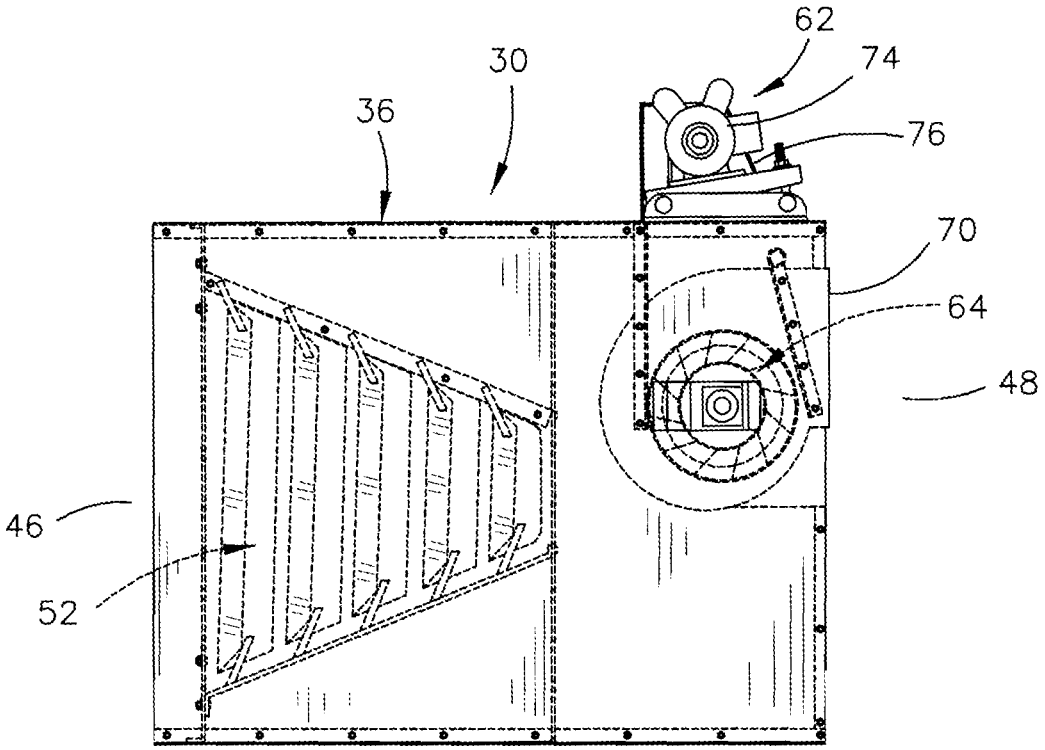
FIG. 4 is a side elevational view of the heat exchanger and dehumidifier apparatus of this invention.
Figure 5:
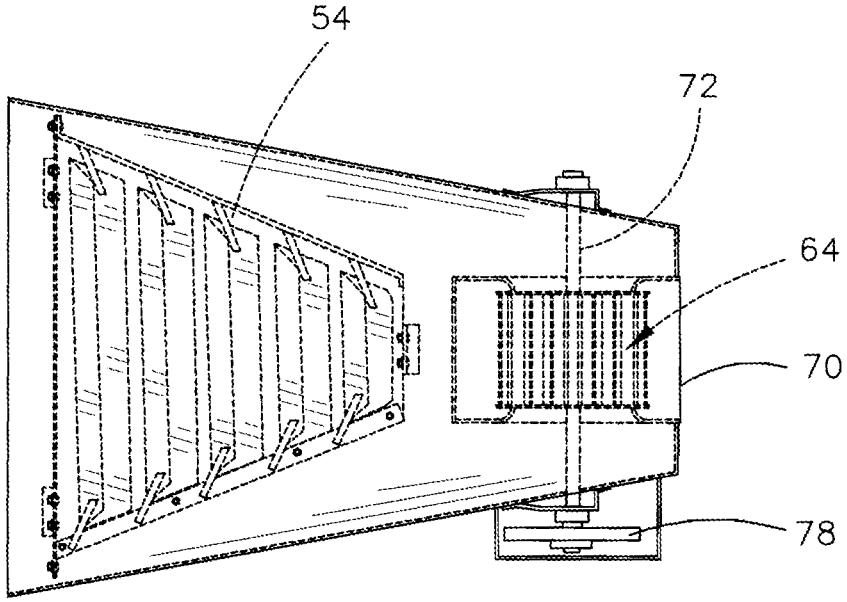
FIG. 5 is a bottom elevational view of the heat exchanger and dehumidifier apparatus of this invention.
Figure 6:
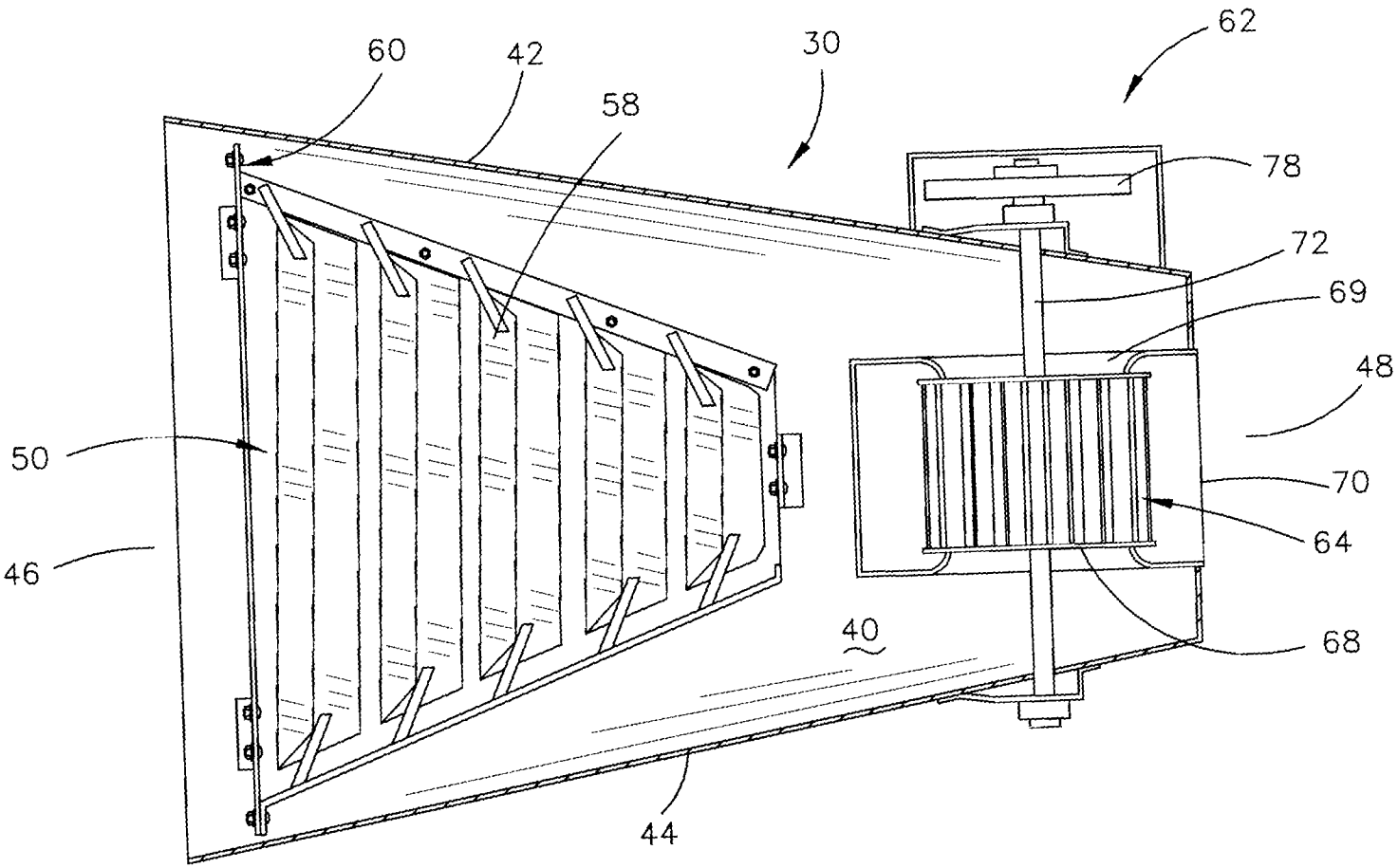
FIG. 6 is a top sectional view of the heat exchanger and dehumidifier apparatus of this invention with the upper wall of the shroud being cut-away to more fully illustrate the invention.

The numeral 26 refers to an infrared heater such as the Val6 Series heater manufactured and sold by Shizuoka Seiki Co., Ltd., having an address of 4-1 Yamana, Fukuroi-shi, Shizuoka-ken, Japan. The infrared heater 26 is diesel fuel fired and emits infrared rays 28 therefrom as illustrated in FIGS. 1 and 3 in conventional fashion when the heater 26 is energized.

The numeral 30 refers to the heat exchanger and dehumidifier apparatus (hereinafter "heat exchanger and dehumidifier") of this invention which enables the heater 26 to be used in conjunction with the air blower 18 so as to provide heated and dehumidified air to be furnished to the inlet end of the air blower 18 so that the air blower 18 may blow the heated and dehumidified air into the plenum 14 and into the grain 16 through the perforated floor 12 in a more efficient manner as will be described in greater detail hereinafter.

Heat exchanger and dehumidifier 30 includes an outer shroud or housing 36 which extends around the internal components of the heat exchanger and dehumidifier 30 and which includes a top wall 38, a bottom wall 40, and opposite side walls 42 and 44. For purposes of description, shroud 36 will be described as having an air inlet end 46 and an air discharge end 48.

Figure 2:
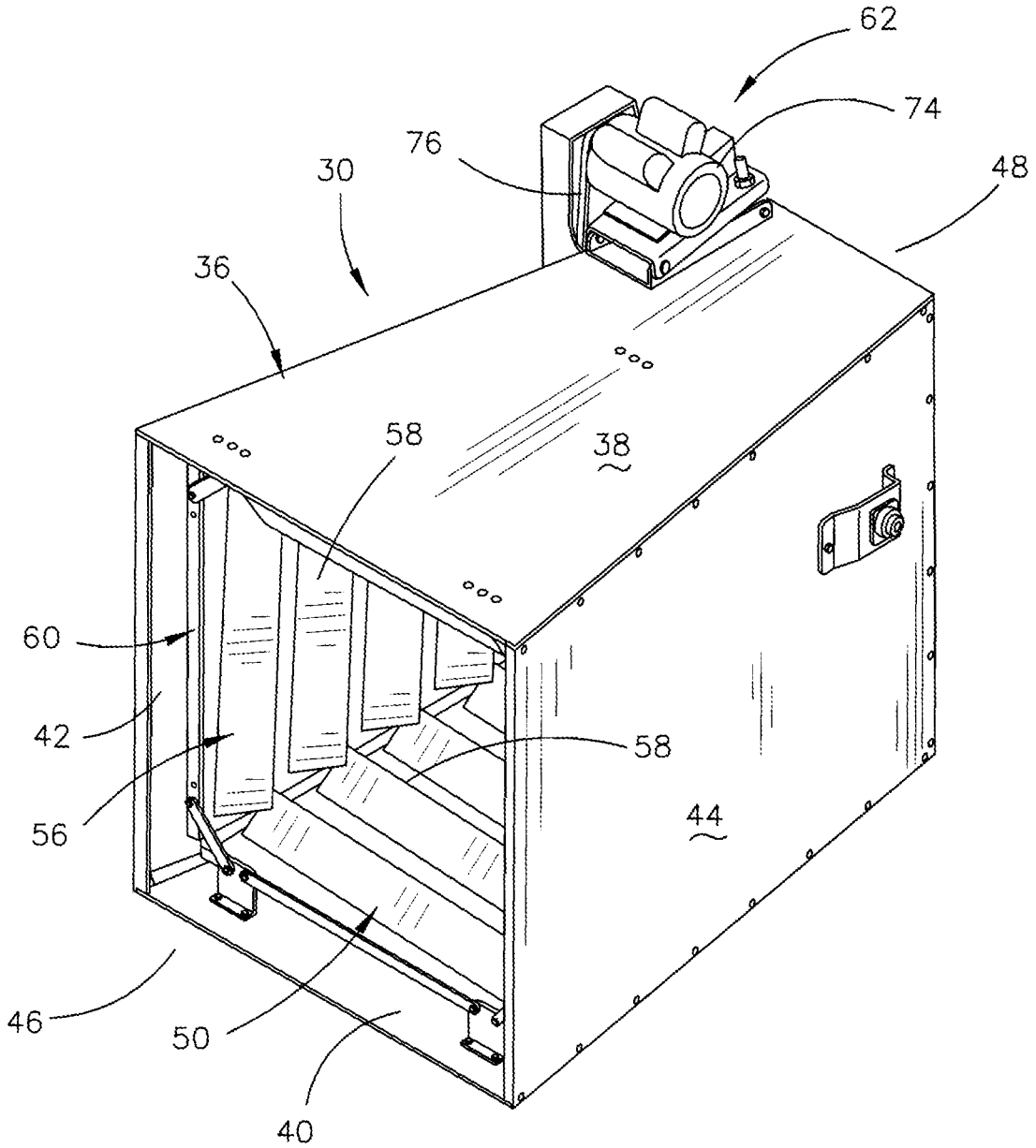
FIG. 2 is a rear perspective view of the heat exchanger and dehumidifier apparatus of this invention.

Shroud 36 is trapezoidal in shape as seen in FIG. 2, with the top wall 38 being trapezoidal-shaped and with the bottom wall 40 being trapezoidal in shape. As seen in FIG. 2, the inlet end 46 of shroud 36 has a greater diameter than the discharge end 48 of shroud 36.

Heat exchanger and dehumidifier 30 includes a first heat exchanger and dehumidifier assembly 50, a second heat exchanger and dehumidifier assembly 52, a third heat exchanger and dehumidifier assembly 54 and a fourth heat exchanger and dehumidifier assembly 56 which define a generally quadrilateral cross-section with the intake end thereof having a larger opening than the discharge end thereof. Each of the heat exchanger and dehumidifier assemblies 50, 52, 54 and 56 include a plurality of spaced-apart, angularly disposed vanes, fins or blades 58. Each of the heat exchanger and dehumidifier assemblies 50, 52, 54 and 56 are generally trapezoidal in shape. Further details of the heat exchanger and dehumidifier apparatus will be described in detail hereinafter.

The vanes 58 are preferably coated with a high temperature dark colored paint to increase the heat absorption of the vanes. The heat exchanger and dehumidifier assemblies 50, 52, 54 and 56 define an air passageway 58 therebetween. The heat exchanger and dehumidifier assemblies 50, 52, 54 and 56 are supported in the shroud 36 by means of a framework 60. The spacing of the shroud 36 from the heat exchanger and dehumidifier assemblies creates an insulation space therebetween to prevent heat loss from the heat exchanger and dehumidifier assemblies.

As seen in the drawings, the discharge side of the heater 26 is spaced from the inlet end of the shroud 36 of heat exchanger and dehumidifier 30. The infrared rays 28 from the heater 26 are directed into the inlet end of the shroud 36 with the vanes 58 being radiantly heated by the infrared rays 28 from the infrared heater 26. When blower 32 is actuated, blower 18 draws or sucks air into the inlet end of the shroud 36 onto the vanes 58 of the heat exchanger and dehumidifier assemblies 50, 52, 54 and 56 respectively with the same being radiantly heated. As the air is being sucked through the passageway between the assemblies 50, 52, 54 and 56 by the blower 18, the air is passed over the vanes 58 and is deflected inwardly by the heat exchanger assemblies 52 and 56, is deflected upwardly by the heat exchanger assembly 50, and is deflected downwardly by the heat exchanger assembly 54. As the air passes over the vanes 58, the air is heated by those heated vanes and is sucked from the discharge end of the heat exchanger 30 into the blower 18 and then into the interior of the storage bin and into the grain to dry the same.

As stated above, the amount of air being drawn into the storage bin 10 may be insufficient to dry the grain 16 in the storage bin 10. Applicant has therefore modified the heat exchanger and dehumidifier 30 to enable a fan or blower assembly 62 at the air discharge end of the shroud 36. Assembly 62 includes a blower 64 which is supported within the shroud 36 at the upper outlet end thereof by support braces 66. Blower 64 includes air intakes 68 and 69 at the sides thereof and an air discharge end 70. Blower 64 is mounted on a shaft 72 which is driven by an electric motor 74 by way of a belt 76 extending from motor 74 to pulley 78 mounted on the end of shaft 72.

The heat exchanger and dehumidifier apparatus 30 dehumidifies the air passing therethrough in a consistent manner to enhance the drying of the grain 16.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. An apparatus for drying grain in a storage bin, comprising:

an air blower having an air inlet end and an air discharge end;

said air discharge end of said air blower being in communication with the interior of the storage bin;

a shroud having an upper wall, a lower wall, a first side wall, a second side wall, an open inlet end and an open outlet end;

said upper wall of said shroud having a trapezoidal shape;

said lower wall of said shroud having a trapezoidal shape;

said upper wall of said shroud including an inlet end, an outlet end, a first side and a second side;

said lower wall of said shroud including an inlet end, an outlet end, a first side and a second side;

said first side wall of said shroud including an inlet end, an outlet end, an upper end and a lower end;

said second side wall of said shroud including an inlet end, an outlet end, an upper end and a lower end;

said first side of said upper wall of said shroud being connected to said upper end of said first side wall of said shroud;

said second side of said upper wall of said shroud being connected to said upper end of said second side wall of said shroud;

said first side of said lower wall of said shroud being connected to said lower end of said first side wall of said shroud;

said second side of said lower wall of said shroud being connected to said lower end of said second side wall of said shroud;

said inlet ends of said upper and lower walls of said shroud having a greater width than said outlet ends of said upper and lower walls whereby said upper and lower walls of said shroud define a trapezoidal shape with the inlet end of said shroud having a greater width than the outlet end thereof;

an upper heat exchanger and dehumidifier assembly positioned in said shroud below said upper wall of said shroud;

said upper heat exchanger and dehumidifier having a first end, a second end, a first side and a second side;

said upper heat exchanger and dehumidifier having a trapezoidal shape;

a lower heat exchanger and dehumidifier assembly positioned in said shroud above said lower wall of said shroud;

said lower heat exchanger and dehumidifier assembly having a first end, a second end, a first side and a second side;

said lower heat exchanger and dehumidifier assembly having a trapezoidal shape;

a first side heat exchanger and dehumidifier assembly positioned in said shroud inwardly of said first side wall of said shroud;

said first side heat exchanger and dehumidifier assembly having a first end, a second end, an upper end and a lower end;

said first side heat exchanger and dehumidifier assembly having a trapezoidal shape;

a second side heat exchanger and dehumidifier assembly positioned in said shroud inwardly of the second side wall of said shroud;

said second side heat exchanger and dehumidifier assembly having a first end, a second end, an upper end and a lower end;

said second heat exchanger and dehumidifier assembly having a trapezoidal shape;

each of said heat exchanger and dehumidifier assemblies having a plurality of spaced-apart vanes provided thereon which are heated by infrared rays passing into said heat exchanger and dehumidifier assemblies;

said upper heat exchanger and dehumidifier assembly, said lower heat exchanger and dehumidifier assembly, said first side heat exchanger and dehumidifier assembly and said second side heat exchanger and dehumidifier assembly defining a heat exchanger and dehumidifier having an air passageway extending therethrough with an inlet end and an outlet end;

said outlet end of said heat exchanger and dehumidifier being spaced from said inlet end of said air blower;

and an infrared heater spaced from said inlet end of said heat exchanger and dehumidifier whereby infrared rays from said infrared heater will be directed into said air passageway of said heat exchanger and dehumidifier so that said heat exchanger and dehumidifier assemblies will be heated by said infrared rays to heat the air being drawn through said heat exchanger and dehumidifier by said air blower;

said air blower sucking heated air from said air passageway and blowing the same into the storage bin to dry the grain therein;

an electric motor mounted on said upper wall of said shroud at said outlet end thereof;

an electric blower positioned in said shroud at said outlet end of said upper wall of said shroud;

said electric blower having an air inlet end and an air discharge end;

said electric blower being coupled to said electric motor; and said electric blower blowing heated and dehumidified air outwardly from said air passageway.

2. A heat exchanger and dehumidifier apparatus, comprising:

a shroud having an upper wall, a lower wall, a first side wall, a second side wall, an open inlet end and an open outlet end;

said upper wall of said shroud having a trapezoidal shape;

said lower wall of said shroud having a trapezoidal shape;

said upper wall of said shroud including an inlet end, an outlet end, a first side and a second side;

said lower wall of said shroud including an inlet end, an outlet end, a first side and a second side;

said first side wall of said shroud including an inlet end, an outlet end, an upper end and a lower end;

said second side wall of said shroud including an inlet end, an outlet end, an upper end and a lower end;

said first side of said upper wall of said shroud being connected to said upper end of said first side wall of said shroud;

said second side of said upper wall of said shroud being connected to said upper end of said second side wall of said shroud;

said first side of said lower wall of said shroud being connected to said lower end of said first side wall of said shroud;

said second side of said lower wall of said shroud being connected to said lower end of said second side wall of said shroud;

said inlet ends of said upper and lower walls of said shroud having a greater width than said outlet ends of said upper and lower walls whereby said upper and lower walls of said shroud define a trapezoidal shape with the inlet end of said shroud having a greater width than the outlet end thereof;

an upper heat exchanger and dehumidifier assembly positioned in said shroud below said upper wall of said shroud;

said upper heat exchanger and dehumidifier assembly having a first end, a second end, a first side and a second side;

said upper heat exchanger and dehumidifier assembly having a trapezoidal shape;

a lower heat exchanger and dehumidifier assembly positioned in said shroud above said lower wall of said shroud;

said lower heat exchanger and dehumidifier assembly having a first end, a second end, a first side and a second side;

said lower heat exchanger and dehumidifier assembly having a trapezoidal shape;

a first side heat exchanger and dehumidifier assembly positioned in said shroud inwardly of said first side wall of said shroud;

said first side heat exchanger and dehumidifier assembly having a first end, a second end, an upper end and a lower end;

said first side heat exchanger and dehumidifier assembly having a trapezoidal shape;

a second side heat exchanger and dehumidifier assembly positioned in said shroud inwardly of the second side wall of said shroud;

said second side heat exchanger and dehumidifier assembly having a first end, a second end, an upper end and a lower end;

said second side heat exchanger and dehumidifier assembly having a trapezoidal shape;

each of said heat exchanger and dehumidifier assemblies having a plurality of spaced-apart vanes provided thereon and an infrared heater spaced from said inlet end of said heat exchanger and dehumidifier whereby infrared rays from said infrared heater will be directed into said air passageway of said heat exchanger and dehumidifier so that said heat exchanger and dehumidifier assemblies will be heated by said infrared rays to heat the air being drawn through said heat exchanger and dehumidifier by said air blower; said air blower sucking heated air from said air passageway and blowing the same into the storage bin to dry the grain therein;

said upper heat exchanger and dehumidifier assembly, said lower heat exchanger and dehumidifier assembly, said first side heat exchanger and dehumidifier assembly and said second side heat exchanger and dehumidifier assembly defining a heat exchanger and dehumidifier having an air passageway extending therethrough with an inlet end and an outlet end;

an electric motor mounted on said upper wall of said shroud at said outlet end thereof;

an electric blower positioned in said shroud at said outlet end of said upper wall of said shroud;

said electric blower having an air inlet end and an air discharge end;

said electric blower being coupled to said electric motor; and said electric blower blowing heated and dehumidified air outwardly from said air passageway.

* * * * *